United States Patent [19]

Wochnowski et al.

[11] 4,004,594

[45] Jan. 25, 1977

[54] METHOD AND APPARATUS FOR CONDITIONING TOBACCO

[75] Inventors: Waldemar Wochnowski, Hamburg; Willi Thiele, Geesthacht; Reinhard Hohm, Pinneberg; Herbert Schmidt, Glinde, all of Germany

[73] Assignee: Hauni-Werke Korber & Co., KG, Hamburg, Germany

[22] Filed: Dec. 19, 1974

[21] Appl. No.: 535,050

[30] Foreign Application Priority Data

Jan. 19, 1974 Germany ..... 2402538

[52] U.S. Cl. ..... 131/135; 131/136; 131/140 R

[51] Int. Cl.[2] ..... A24B 9/00

[58] Field of Search ..... 131/127, 134, 133, 135, 131/136, 137, 84 B, 140; 35/10, 57 A

[56] References Cited

UNITED STATES PATENTS 3,799,176 3/1974 Wochnowski ..... 131/140 R X

FOREIGN PATENTS OR APPLICATIONS 1,801,548 5/1970 Germany ..... 131/84 B

*Primary Examiner*—Robert W. Michell
*Assistant Examiner*—V. Millin
*Attorney, Agent, or Firm*—Peter K. Kontler; John Kurucz

[57] ABSTRACT

Tobacco particles, particularly Burley tobacco, which form a continuous stream are conditioned during transport by a series of vibratory conveyors. The foremost conveyor receives tobacco particles from a unit which contacts the particles with an atomized liquid, especially casing, and the conveyors thereupon transport the particles seriatim through preconditioning, heating, cooling and moisturizing units. The preconditioning unit has a housing consisting of one or more coiled steam pipes having orifices which discharge currents of steam against the underside of the tobacco stream at a pressure which suffices to enable the currents to form a cushion for the moving tobacco particles. The currents condense on contact with the relatively cool tobacco particles whereby the particles entrain the condensate into the heating unit wherein the particles are relieved of nitrogen and the casing is caused to penetrate into the fibrous structure of each particle with attendant roasting of the casing. The moisturizing unit may be similar to the preconditioning unit but is then further provided with one or more nozzles serving to sprinkle finely atomized water onto the particles which are supported by the cushion of steam in the housing of the moisturizing unit. The temperature of tobacco particles is measured immediately downstream of the heating unit and, if the measured temperature deviates from a desired temperature, a control circuit automatically changes the temperature and/or moisture content of hot air which is used for heating, the rate of tobacco feed to the vibratory conveyor(s) or the length of intervals of dwell of tobacco particles in the heating unit.

29 Claims, 5 Drawing Figures

METHOD AND APPARATUS FOR CONDITIONING TOBACCO

BACKGROUND OF THE INVENTION

The present invention relates to a method and apparatus for conditioning tobacco, and more particularly to improvements in a method and apparatus for conditioning tobacco which is transported in the form of a continuous stream by one or more vibratory conveyors and is treated by fluids at least some of which are caused to pass across the path of the tobacco stream.

The conditioning of tobacco involves bringing tobacco particles into contact with one or more fluids. The conditioning may be carried out in one or more stages, depending on the condition of tobacco prior to treatment, on the type of tobacco, on the nature of treatment and on the desired characteristics of conditioned tobacco. In many instances, the conditioning involves contact between tobacco and air or another gaseous fluid having a predetermined temperature and/or moisture content. For example, it is known to convey tobacco particles in the form of a stream which is transported lengthwise by one or more vibratory conveyors and is contacted by currents of air passing across the path for the stream.

SUMMARY OF THE INVENTION

An object of the invention is to provide a novel and improved method of conditioning tobacco, such as Burley tobacco, preferably in a series of successive stages and in such a way that the treatment can be completed in a small area, within a short interval of time, and with a high degree of reproducibility.

Another object of the invention is to provide a conditioning method which invariably insures intensive contact between one or more fluids and tobacco while the particles of tobacco are caused to advance along a relatively short path.

A further object of the invention is to provide a method which can be used for thorough impregnation of tobacco particles with a suitable casing, for expulsion of nitrogen from tobacco, and/or for changing the moisture content of tobacco particles to a desired value.

An additional object of the invention is to provide a method which can be used for the treatment of different types of tobacco and which can be practiced by resorting to a relatively simple, compact and versatile apparatus.

A further object of the invention is to provide a conditioning apparatus which can treat large quantities of tobacco per unit of time with a high degree of reproducibility, which can be readily adjusted in order to change the ultimate characteristics of treated material, and which requires little or no supervision.

One feature of the invention resides in the provision of a method of conditioning tobacco. The method comprises the steps of transporting a continuous stream of tobacco particles along a predetermined path including vibrating the particles of the stream, continuously conveying across a predetermined portion of the path a plurality of ascending currents of a hot vaporized liquid medium (preferably superheated steam), and maintaining the currents at a pressure at which the currents together form a cushion which has a constant or substantially constant thickness and supports the particles of tobacco during transport along the predetermined portion of the path. Thus, the currents cannot appreciably lift the particles above the predetermined path. The method may comprise the additional steps of maintaining the particles of tobacco upstream of the predetermined portion of the path at a relatively low first temperature and of conveying the currents of vaporized medium at a second temperature which is higher than the first temperature. The difference between the first and second temperatures and the presence of currents are preferably such that the speed of currents above the tobacco stream decreases pronouncedly and at least a substantial portion of or the entire vaporized medium undergoes condensation and the condensed medium deposits on the particles of tobacco. Thus, the vaporized medium forms a cushion below the stream, and that part of the medium which passes across the stream is decelerated and condensed with attendant entrainment of condensate beyond the predetermined portion of the path.

The method preferably comprises the additional steps of heating the particles of tobacco in a second portion of the path, cooling the thus heated particles in a third portion of the path, and increasing the moisture content of tobacco particles in a fourth portion of the path. The heating, cooling and moisture increasing steps may comprise contacting the particles of tobacco with streamlets of a fluid medium (e.g., air). However, at least one of the media (e.g., the vaporized medium which contacts tobacco particles in the predetermined portion of the path and the fluid medium which contacts the particles of tobacco in the fourth portion of the path) is preferably steam.

The method may further comprise the steps of monitoring the temperature of tobacco particles between the second and third portions of the path (preferably immediately upon completion of the heating step and preferably by direct measurement of tobacco temperature), comparing the measured temperature with a predetermined value, and changing at least one factor which influences the temperature of tobacco particles whenever the measured temperature deviates from the predetermined value. The heating step preferably comprises contacting tobacco particles wth a hot gaseous fluid (preferably air), and the aforementioned changing step may comprise varying the temperature and/or moisture content of such gaseous fluid. Alternatively, the changing step may comprise varying the rate at which the particles of tobacco are transported along the second portion of the path and/or varying the speed of transport of tobacco particles during heating.

The moisture increasing or moisturizing step may comprise simultaneously contacting tobacco particles with steam and atomized liquid. Steam may be conveyed across the fourth portion of the path in the form of ascending currents which together form a cushion for the particles moving along the fourth portion of the path, and the atomized liquid is preferably sprinkled onto the particles of tobacco on such cushion.

The method preferably further comprises the additional step of contacting successive increments of the tobacco stream with an atomized liquid (e.g., casing) in a further portion of the path which is located ahead of the predetermined portion whereby such liquid (casing) penetrates into the fibrous structure of tobacco particles as a result of contact between liquid-carrying particles and vaporized medium in the predetermined portion of the path. This is due to the fact that vaporized medium opens the pores of tobacco particles and thus allows for deep penetration of the liquid (casing) into the fibrous material of tobacco. The liquid which has penetrated into the fibrous structure of tobacco is roasted in the course of the heating step, and such heating step may also result in expulsion of nitrogen from tobacco particles, e.g., from particles of Burley tobacco.

The novel features which are considered as characteristic of the invention are set forth in particular in the appended claims. The improved conditioning apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
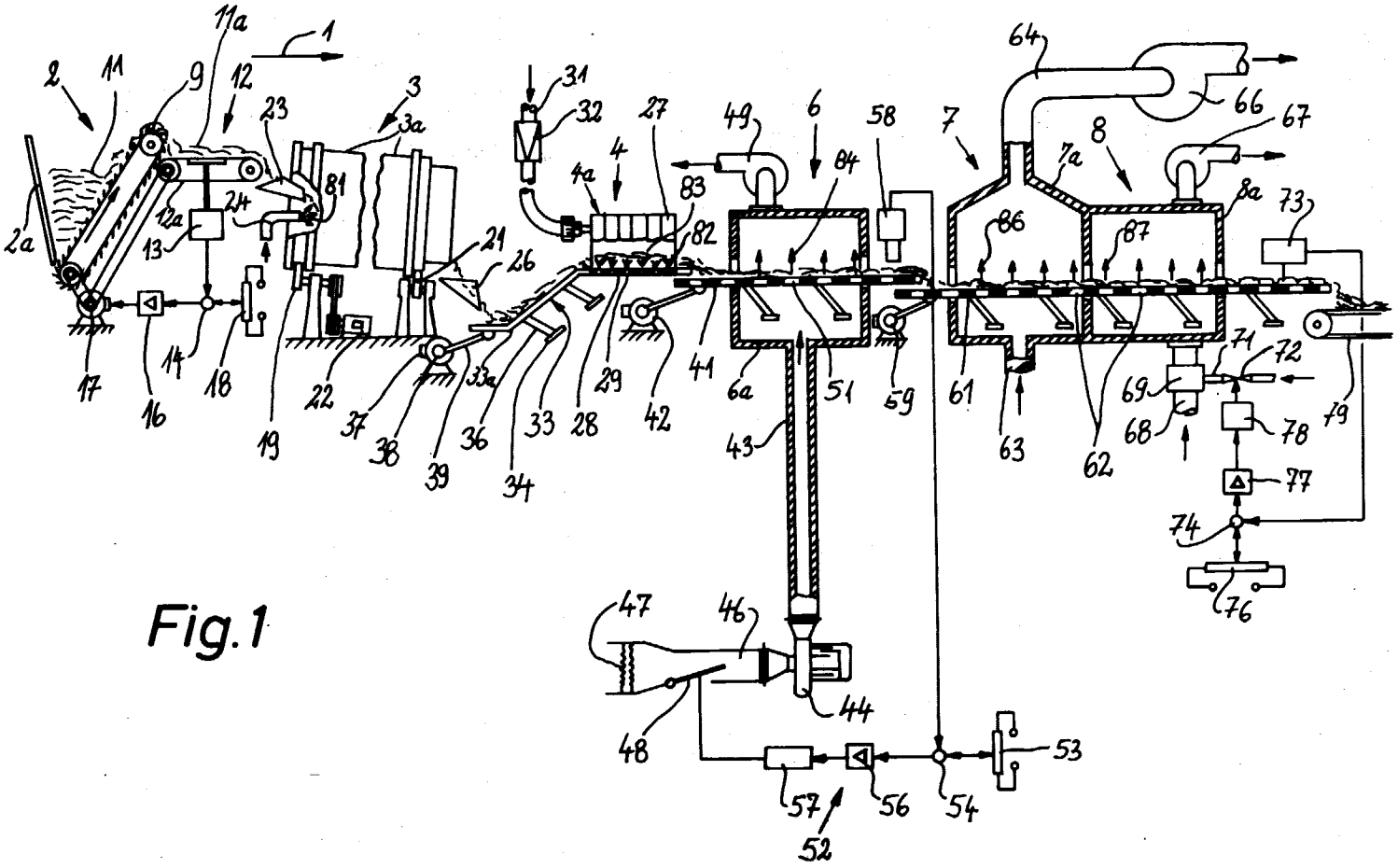
FIG. 1 is a diagrammatic partly elevational and partly longitudinal vertical sectional view of an apparatus which can be used with advantage for conditioning of Burley tobacco and embodies one form of the invention.

FIG. 1 shows an apparatus for conditioning of Burley tobacco. The arrow 1 indicates the direction in which the particles of tobacco (e.g., leaves or fragments of leaves) are transported through the apparatus, and the apparatus comprises a series of successive units including a feeding and metering unit 2, a casing admitting unit 3, a preconditioning unit 4, a heating unit 6, a cooling unit 7 and a moistening or wetting unit 8.

The feeding and metering unit 2 comprises a magazine 2*a* which contains a source of supply 11 of Burley tobacco and one wall of which is constituted by the upwardly moving stretch of a carded belt conveyor 9. The conveyor 9 withdraws from the source 11 a continuous stream 11*a* of tobacco particles at a rate which is determined by a weighing device 12 having an endless belt 12*a*. The construction of the weighing device 12 is known; this device further comprises a transducer 13 which produces a succession of signals whose intensity or another characteristic is indicative of the weight of unit lengths of the tobacco stream 11*a* on the upper stretch of the belt 12*a*. Such signals are transmitted to a signal comparing junction 14 which further receives signals from an adjustable potentiometer 18 serving as a rated value selector. When the intensity of signal from the transducer 13 deviates from the intensity of signal which is furnished by the potentiometer 18, the junction 14 transmits a positive or negative signal to an amplifier 16 which changes the speed of an infinitely variable-speed d-c motor 17. The latter drives the conveyor 9 and belt 12*a*.

The casing admitting unit 3 comprises a rotary drum 3*a* which is supported by rollers 19, 21 and is driven by a prime mover 22 preferably including an electric motor, a variable-speed transmission driven by the motor, a belt drive receiving motion from the output element of the transmission, and a pinion which is rotated by the belt drive and meshes with a ring gear on the drum 3*a*. As a rule, the motor of the prime mover 22 is operated at a constant speed. The means for admitting a spray 81 of liquid casing into the interior of the drum 3*a* comprises a supply conduit 24 having at its discharge end a suitable nozzle which discharges atomized casing onto the particles of the stream 11*a* in a region close to the intake end of the continuously rotating drum 3*a*. The source of casing and the pump which causes casing to flow from the source into the supply conduit 24 are not shown in FIG. 1. A chute 23 is disposed between the intake end of the drum 3*a* and the discharge end of the conveyor belt 12*a* to feed successive increments of the stream 11*a* into the spray 81. The axis of the drum 3*a* is slightly inclined downwardly, as viewed in the direction indicated by the arrow 1, and the discharge end of the drum supplies successive increments of the stream 11*a* into a second chute 26 which latter feeds tobacco particles onto a vibratory conveyor 33.

The conveyor 33 transports the stream 11*a* through the preconditioning unit 4 which comprises a housing or chamber 4*a* formed by the coils of a steam pipe 27. The housing 4*a* may resemble a substantially horizontal tube which is open at both ends and the coils of the pipe 27 may merely abut against or are actually bonded to each other. The inner sides of the coils in the lower portion or bottom wall 28 of the housing 4*a* are formed with orifices 29 which discharge ascending currents 82 of steam against the underside of the tobacco stream 11*a*. The leftmost coil of the pipe 27 receives steam from a supply pipe 31 which contains a pressure regulating valve 32. The housing 4*a* is mounted on and can be said to form part of the vibratory conveyor 33 (or vice versa). The latter comprises stationary carriers or supports 34 for flexible arms 36 (e.g., leaf springs) which mount a vibrating table 33*a* serving to convey successive increments of the stream 11*a* into the housing 4*a*. The table 33*a* (and hence the housing 4*a*) is vibrated by an electric motor 37 whose output shaft drives a disk 38 having an eccentric pin coupled to one end portion of a connecting rod 39. The other end portion of the connecting rod 39 is articulately connected to the table 33*a*. This table can be replaced by a trough which confines the tobacco stream 11*a* on its way into the housing 4*a*.

The heating unit 6 is adjacent to a second vibratory conveyor 41 which serves to transport the stream 11*a* through a heating chamber 6*a*. The conveyor 41 is vibrated by an electric motor 42 in a manner similar to that described for the conveyor 33, and its left-hand end portion receives tobacco particles from the housing 4*a*. The openings in the left-hand and right-hand side walls of the chamber 6*a* are just large enough to permit the conveyor 41 to vibrate and to allow for unimpeded entry and evacuation of successive increments of the tobacco stream 11*a*.

The heating unit 6 further comprises a system for conveying currents of air upwardly through the tobacco stream 11*a* on the vibratory conveyor 41. This system comprises a supply pipe 43 which discharges hot air into the lower portion of the chamber 6*a* below the vibratory conveyor 41. The latter has apertures 51 through which streamlets or currents 84 of air can pass upwardly through the tobacco stream 11*a* and into the upper portion of the chamber 6*a*. A fan 49 has an inlet connected with an opening in the top wall of the chamber 6a and serves to evacuate spent air from the heating unit 6. The inlet of the supply pipe 43 is connected to the outlet of a blower 44 which draws heated air from a suction pipe 46. The left-hand end portion of the pipe 46 is open and contains an electric resistance heater 47 which heats the inflowing atmospheric air. A valve 48 (here shown as a pivotable flap) is mounted in the suction pipe 46 between the heater 47 and blower 44 and serves as a means for admitting unheated atmospheric air into the stream of heated air flowing from the heater 47 into the intake end of the blower 44. It will be seen that the temperature of the air stream in the supply pipe 43 is a function of the angular position of the valve 48.

The means for changing the position of the valve 48 comprises a control circuit 52 including a signal comparing junction 54 one input of which is connected to a temperature monitoring device 58 and another input of which is connected with an adjustable potentiometer 53 constituting a rated value selector for the temperature of air in the pipe 43. British patent specification No. 1,114,459 describes a temperature monitoring device of the type capable of being used in the apparatus of the present invention. The monitoring device 58 is adjacent to the path of successive increments of the tobacco stream 11a which issues from the chamber 6a and is preferably of the type which does not come into actual contact with tobacco. For example, the device 58 may comprise an element capable of sensing heat which is radiated by the tobacco stream 11 immediately downstream of the chamber 6a and a transducer serving to transmit electric signals whose intensity or another characteristic is indicative of the temperature of the respective increments of the stream 11a. The junction 54 compares the signals from the monitoring device 58 with those furnished by the potentiometer 53 and transmits positive or negative signals to an amplifier 56 when the measured temperature deviates from the rated temperature. The amplifier 56 then starts a servomotor 57 which pivots the valve 48 in a direction to reduce the quantity of cool atmospheric air when the measured temperature of the tobacco stream 11a is too low and to increase the quantity of admitted cool atmospheric air when the temperature of the tobacco stream 11a on the rightmost portion of the vibratory conveyor 41 is too high.

A third vibratory conveyor 61 has apertures 62 and is maintained in vibratory motion by an electric motor 59. This conveyor transports the stream 11a through the units 7 and 8. The cooling unit 7 comprises a chamber 7a whose side walls have openings similar to those in the side walls of the chamber 6a and which confines the leftmost portion of the conveyor 61. The latter receives tobacco from the vibratory conveyor 41 and causes successive increments of the stream 11a to move in the direction indicated by arrow 1 whereby the stream is traversed by currents 86 of atmospheric air which is admitted into the lower portion of the chamber 7a by a supply pipe 63 and is evacuated from the upper portion of the chamber 7a by a fan 66 having its intake connected to a discharge pipe 64 communicating with the chamber 7a at a level above the conveyor 61.

The conveyors 33, 41, 61 together constitute a composite vibratory conveyor which transports the tobacco stream 11a from the discharge end of the drum 3a, through the units 4, 6, 7 and through and beyond the moistening unit 8. The latter comprises a chamber 8a which is immediately adjacent to or made integral with the chamber 7a of the cooling unit 7 and whose side walls have openings for the conveyor 61 and the tobacco stream 11a. A fan 67 of the moistening unit 8 draws air from the upper portion of the chamber 8a at a level above the conveyor 61. Moist air is admitted into the lower portion of the chamber 8a through a supply pipe 68 which contains a moisture admitting device or atomizer 69. The latter receives metered quantities of water by way of a supply conduit 71 which contains an electrically adjustable regulating valve 72. The control circuit which adjusts the valve 72 and hence the moisture content of air in the supply pipe 68 comprises a moisture detector 73 which is adjacent to the rightmost portion of the vibratory conveyor 61 downstream of the chamber 8a and transmits electric signals to a junction 74 which further receives signals from an adjustable potentiometer 76 constituting a rated value selector. When the moisture content of tobacco issuing from the heating unit 8 deviates from a desired moisture content (as selected by the setting of potentiometer 76), the junction 74 transmits a positive or negative signal to an amplifier 77 which actuates a servomotor 78 whereby the latter adjusts the valve 72 to admit more water into the atomizer 69 when the moisture content of conditioned tobacco is too low or vice versa. Thus, the effective cross-sectional area of the passage which is defined by the valve 72 for the flow of water from a source (not shown) into the atomizer 69 is variable in dependency on deviations of final moisture content from a desired optimum moisture content.

The exact construction of the valve 72 and servomotor 78 forms no part of the invention. For example, the valve 72 may comprise a moving coil whose position can be changed in response to transmission of positive or negative signals to the servomotor 78, and such moving coil thereby changes the position of a spool or another valve member which directly controls the rate of water flow in the conduit 71. The coil is movable in a magnetic field whose intensity can be varied by the servomotor 78.

The exact construction of the moisture detector 73 forms no part of the invention. This detector may be of the type known as HWK produced by Hauni-Werke Korber & Co. KG, of Hamburg-Bergedorf, Western Germany.

The conditioning apparatus further comprises a take-off conveyor 79 (e.g., an endless belt) which transports conditioned tobacco to a further processing station or into storage. For example, the conveyor 79 can deliver Burley tobacco to a blending unit where the tobacco is mixed with one or more other types of tobacco, to a shredding machine or into the magazine of a machine for the making of a wrapped tobacco filler rod.

The operation is as follows.

The magazine 2a of the feeding and metering unit 2 receives Burley tobacco at regular or irregular intervals or continuously, and the supply 11 is preferably monitored by one or more preferably photoelectric detectors so that the quantity of tobacco in the magazine 2a is either constant or fluctuates negligibly between a maximum and a minimum quantity. This enables the conveyor belt 9 to draw from the magazine 2a tobacco at a substantially constant rate whereby the tobacco stream 11a advances with the upper stretch of the belt 12a. Eventual deviations of the weight of successive unit lengths of the stream 11*a* from a predetermined value are detected by the weighing device 12 whereby the transducer 13 transmits signals to the junction 14 which compares such signals with signals from the potentiometer 18 and causes the amplifier 16 to change the speed of the motor 17 when necessary. Thus, the chute 23 delivers tobacco at a constant rate and such tobacco enters the spray 81 of liquid casing which is being discharged by the supply conduit 24 at the open left-hand end of the rotating drum 3*a*. The composition of casing which is being supplied by the conduit 24 forms no part of the invention. The drum 3*a* may be provided with internal vanes or paddles to promote agitation of the particles which form the stream 11*a* and to thus insure a more intimate contact of atomized casing with each and every particle of tobacco as well as with each portion of each tobacco particle. The admission of casing via pipe 24 increases the moisture content of tobacco particles which leave the unit 3 by way of the open right-hand end of the drum 3*a* to pass through the chute 26 and to descend onto the platform 33*a* of the first vibratory conveyor 33.

The conveyor 33 causes the stream 11*a* to advance through the interior of the housing 4*a* in the preconditioning unit 4 whereby the particles of tobacco are contacted by currents 82 of steam issuing from the orifices 29 in the bottom wall 28 of the housing 4*a*. The pressure (and hence the quantity) of steam which is being admitted into the housing 4*a* can be regulated by the valve 32 in the supply pipe 31. The pressure of steam will depend on the nature of tobacco which forms the stream 11*a*. The setting of the valve 32 is preferably selected in such a way that the currents 82 of steam which issue from the orifices 29 expand as soon as they enter the interior of the housing 4*a* above the tobacco stream 11*a* and are condensed on the particles of tobacco. Such particles are agitated by the vibrating housing 4*a*. Thus, currents 82 of steam are converted into liquid which is completely or practically completely deposited on the particles of the stream 11*a*. Condensation of steam on the internal surface of the housing 4*a* is prevented due to the fact that this housing is formed by the coiled pipe 27 which contains hot steam. It has been found that the pressure of steam in the pipe 31 downstream of the regulating valve 32 can be readily selected in such a way that the particles of tobacco travelling through the interior of the housing 4*a* (see the tobacco stream portion 83) are carried by a cushion consisting of steam and having a constant or nearly constant thickness and are thereby subjected to a very intensive action of the vaporized medium issuing from the orifices 29. This insures that the steam opens the pores of the particles and enables the casing to penetrate well into the fibrous structure of the particles. The pressure of steam should not be too high, i.e., the currents 82 should not affect the rate of tobacco transport through the housing 4*a* by lifting certain particles well above the tobacco stream portion 83.

The just described mode of subjecting the particles of the tobacco stream 11*a* to a preliminary of preconditioning treatment can be varied in a number of ways. For example, the penetration of casing into the fibrous structure of tobacco particles can be enhanced by a high-frequency treatment, by a microwave treatment or by contact with a body of air which is maintained in a state of hygroscopic equilibrium with tobacco. However, it has been found that the treatment of tobacco with steam (vaporized liquid medium) is more effective and less expensive than the just described treatments.

Tobacco particles are impregnated with moisture and casing not later than when they leave the interior of the housing 4*a* to descend onto the upper side of the vibratory conveyor 41. The latter transports successive increments of the stream 11*a* through the chamber 6*a* of the heating unit 6. The pipe 43 supplies a continuous stream of heated air which passes through the apertures 51 in the form of currents 84. Such currents agitate the particles of the stream 11*a* so that the particles form a layer which is carried by a cushion of hot air to thus insure that all sides of each particle are contacted by the gaseous heating fluid This insures an optimum exchange of heat between hot air and the particles of the stream 11*a* with a pronounced drying of tobacco whereby the casing which has penetrated into the fibrous structure of tobacco is "burned" into the tobacco particles, i.e., the tobacco is roasted with a high degree of uniformity. Incrustation of the outermost layers of tobacco particles is prevented due to preceding treatment in the housing 4*a*, namely because the conditioning with steam issuing from the orifices 29 has insured penetration of casing and moisture well into the interior of each tobacco particle.

The treatment in the chamber 6*a* raises the temperature of tobacco particles, and such temperature is monitored by the device 58 which transmits corresponding electric signals to the junction 54 of the control circuit 52. This junction transmits signals to the amplifier 56 whenever the measured temperature deviates from a desired temperature (as selected by setting of the potentiometer 53) whereby the servomotor 57 changes the angular position of the valve 48 and hence the temperature of air in the supply pipe 43. An advantage of the control circuit 52 is that it can correct the temperature of tobacco particles practically without any delay because the device 58 is mounted immediately downstream of the chamber 6*a* and the adjustment of valve 48 immediately follows the detection of each and every deviation of measured temperature from a desired optimum temperature. It is clear that the valve 48 can be replaced by or used in addition to a device which changes the heating action of the heater 47 whenever the measured temperature of tobacco particles downstream of the chamber 6*a* deviates from an optimum temperature.

If the material to be treated is Burley tobacco, the heating in chamber 6*a* is preferably sufficiently intensive to insure that the temperature of tobacco is increased to a desired value, that the moistuure content of tobacco is reduced to a desired value, as well as that the heating expels nitrogen from Burley tobacco. The thus heated tobacco thereupon descends onto the vibratory conveyor 61 and is introduced into the cooling chamber 7*a*. In this chamber, the particles of tobacco are contacted by currents 86 of cool atmospheric air which is drawn by the fan 66 to enter the chamber 7*a* via supply pipe 63, to pass through the apertures 62, and to leave the chamber 7*a* via discharge pipe 64. The rate at which the fan 66 draws air into the chamber 7*a* is preferably such that the currents 86 form a cushion on which the particles of tobacco rest during travel through the cooling unit 7 whereby each and every side of each tobacco particle is brought into intimate and repeated heat exchanging contact with cool air. Intensive exchange of heat between tobacco particles and cool air (currents 86) is desirable in order to insure that the particles will be capable of accepting and retaining requisite amounts of moisture during transport through the unit 8. As a rule, or in many instances, the drying action of hot air in the chamber 6*a* is such that the moisture content of tobacco particles leaving the heating unit 6 is well below the desired final moisture content. The particles which have been cooled in the chamber 7*a* thereupon enter the chamber 8*a* to be contacted by streamlets or currents 87 of moist air supplied by the pipe 68 and passing through the apertures 62 of the vibratory conveyor 61. The moisture content of air entering the chamber 8*a* via pipe 68 is increased by the atomizer 69 which receives water from a source (e.g., a faucet) via conduit 71 and at a rate determined by the setting of valve 72. The currents 87 of moist air preferably form a cushion on which the particles of tobacco rest during transport through the chamber 8*a*. This insures that each and every particle is brought into intimate contact with moist air so that the particles of tobacco accept substantial quantities of moisture. The final moisture content is determined by the detector 73 which causes the junction 74 to transmit a positive or negative signal when the measured final moisture content deviates from that which is selected by the setting of potentiometer 76. Such signal effects an appropriate adjustment of the valve 72 which changes the rate of water flow into the atomizer 69 and hence the moisture content of air leaving the pipe 68.

The unit 8 constitutes but one of various means for insuring that the final moisture content of tobacco particles is increased to a desired value subsequent to heating in the unit 6 and cooling in the unit 7. For example, the moisture content of tobacco particles which leave the cooling unit 7 could be raised by contacting the particles with steam and by sprinkling water onto the particles of tobacco leaving the unit 7 (see FIG. 5), or by contacting the particles of tobacco with a stream of air (flowing concurrent with or countercurrent to the direction of tobacco transport) which contacts the particles as long as is necessary to establish a hygroscopic equilibrium between air and tobacco.

The conditioned tobacco stream is thereupon advanced by the take-off conveyor 79 to the next processing station.

The dimensions and configuration of housing 4*a* and other parts of the apparatus of FIG. 1 depend on a number of factors, such as the rate at which the particles of tobacco are transported through successive units, the initial moisture content of tobacco, and the nature and quantity of casing which is being supplied by the conduit 24. It has been found that Burley tobacco can be treated satisfactorily if the steam pressure in the supply pipe 31 downstream of the valve 32 is 2.5–3.5 atmospheres superatmospheric pressure and if saturated steam which is supplied by the pipe 31 is maintained at a temperature of 138–147° C.

By way of example only, the apparatus of FIG. 1 can be dimensioned and operated as follows. The carded conveyor belt 9 feeds Burley tobacco at the rate of 2,240 kilograms per hour and the initial moisture content of tobacco is 14–20 percent, preferably 18 percent. The conduit 24 supplies casing at such a rate that the chute 26 conveys 2,700 kilograms of tobacco (with casing) per hour. The moisture content of tobacco in the chute 26 is 30–42 percent, preferably 32 percent, and the temperature of tobacco in the chute is 40° C.

The conduit 31 supplies into the housing 4*a* satsurated steam which not only agitates the particles of tobacco on the bottom wall 28 but also condenses on the tobacco particles. The conduit 31 supplies 100 kilograms of steam per hour, and the pressure of steam is 2–4 (preferably 3.5) atmospheres superatmospheric pressure. The temperature of steam issuing from the orifices 29 is between 138° and 147° C. During passage through the housing 4*a*, the temperature of tobacco rises by 30°–40° C., preferably to 70° C., and the moisture content of tobacco rises to approximately 35 percent. The width of the housing 4*a* is 1 meter and the diameters of the orifices 29 are in the range of 0.8–1 millimeter.

The temperature of hot air in the chamber 6*a* of the heating unit 6 is 140°–240° C., preferably 180° C., and the temperature of tobacco in the chamber 6*a* rises to 80°–140° C., preferably to 105° C. Such heating reduces the moisture content of tobacco to 4–7 percent. The number and size of the apertures 51 in chamber 6*a* are such that the combined cross-sectional area of apertures 51 is about 7 percent of the area of the vibratory conveyor 41 in the heating unit 6.

During travel through the chamber 7*a*, the particles of the tobacco stream 11*a* are cooled to about 40° C. and the treatment in chamber 8*a* raises the moisture content of tobacco to 18–22 percent.

Figure 2:
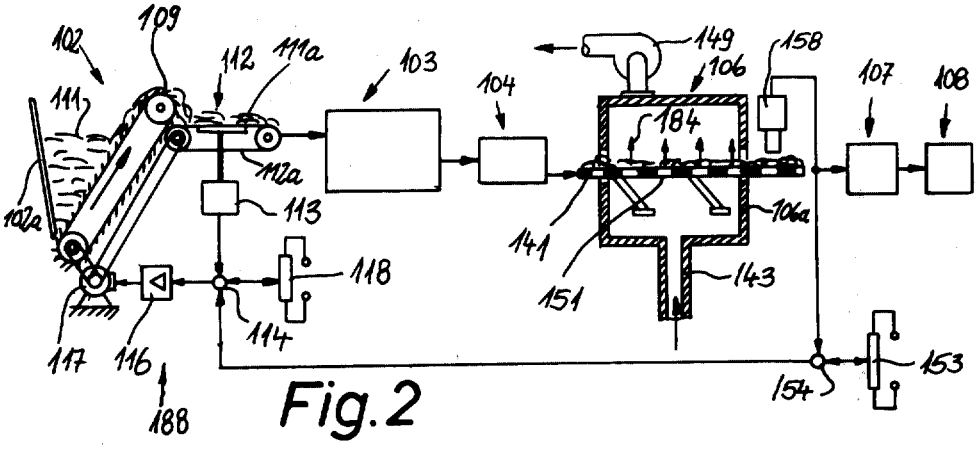
FIG. 2 is a diagrammatic partly elevational and partly longitudinal vertical sectional view of a second apparatus.

FIG. 2 shows a second conditioning apparatus wherein all such units, devices and other parts which are identical with or clearly analogous to the corresponding parts of the first apparatus are denoted by similar reference characters plus 100. The main difference between the first conditioning apparatus and the apparatus of FIG. 2 is that deviations of the temperature of tobacco particles leaving the heating unit 106 from a desired temperature (as selected by the setting of potentiometer 153) are compensated for and eliminated in a different way. The supply pipe 143 of the heating unit 106 conveys hot air whose temperature is constant. This can be achieved by connecting the inlet of the pipe 143 with a blower 44 of FIG. 1 while omitting the adjustable valve 48 in the suction pipe for the blower so that atmospheric air which enters the suction pipe is heated at a constant rate by the heater 47 of FIG. 1 or by analogous heating means.

The temperature monitoring device 158 of FIG. 2 transmits electric signals to a junction 154 which also receives signals from the potentiometer 153. The output of the junction 154 is connected with a junction 114 which corresponds to the junction 14 of FIG. 1, i.e., which further receives signals from the potentiometer 118 and transducer 113. The signal from junction 154 can change the speed of the motor 117 for the conveyor belts 109, 112*a*. Such signal is superimposed upon the signals from 118 and 113, and the junction 114 (which forms part of a modified control circuit 188) then transmits a positive or negative signal to the amplifier 116 which changes the speed of the motor 117. Thus, the rate at which the conveyor 109 draws tobacco from the magazine 102*a* remains constant (as determined by potentiometer 118) when the temperature of tobacco particles leaving the chamber 106*a* of the heating unit 106 does not deviate from the temperature which is selected by the potentiometer 153. However, if the measured temperature deviates from the desired temperature, the speed of the motor 117 is changed (to change the rate of tobacco feed to the unit 103) even though the changed rate does not reflect the setting of the potentiometer 118. The quantity of tobacco which is fed to the heating unit 106 per unit of time is reduced if the temperature of tobacco particles leaving the chamber 106*a* is too low, and the quantity of tobacco is increased if the temperature which is detected by the monitoring device 158 is too high.

Figure 3:
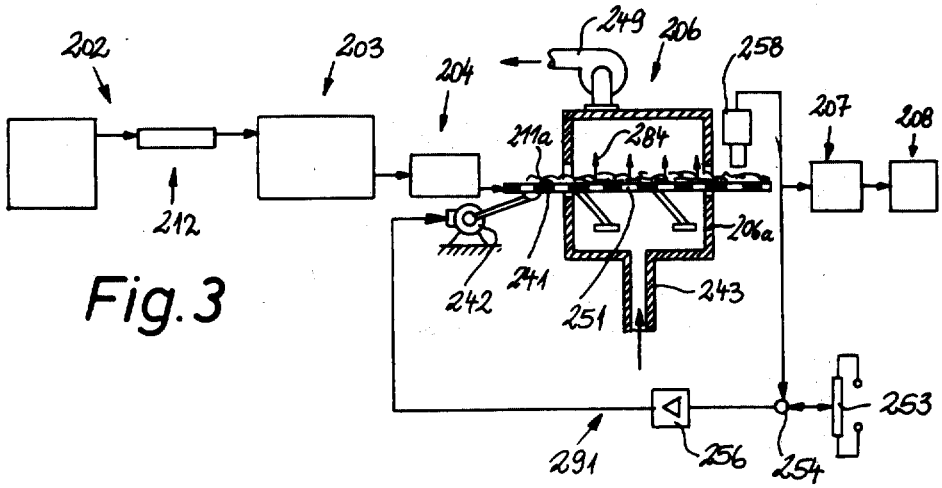
FIG. 3 is a similar view of a third apparatus.

FIG. 3 shows a third conditioning apparatus wherein all such parts which are identical with or clearly analogous to the corresponding parts of the apparatus of FIG. 1 are denoted by similar reference characters plus 200. The main difference is that the signals from the monitoring device 258 regulate the frequency of vibratory movements of the conveyor 241, i.e., such signals are transmitted to the junction 254 (forming part of a modified control circuit 291) which causes an amplifier 256 of the circuit 291 to change the speed of the motor 242. By changing the speed of the motor 242, the control circuit 291 changes the length of intervals during which a particle of the tobacco stream 211*a* remains in the chamber 206*a* of the heating unit 206. The length of intervals is reduced if the monitored temperature is too high, and vice versa. This can be achieved by changing the frequency and/or amplitude of vibrations of the conveyor 241.

Figure 4:
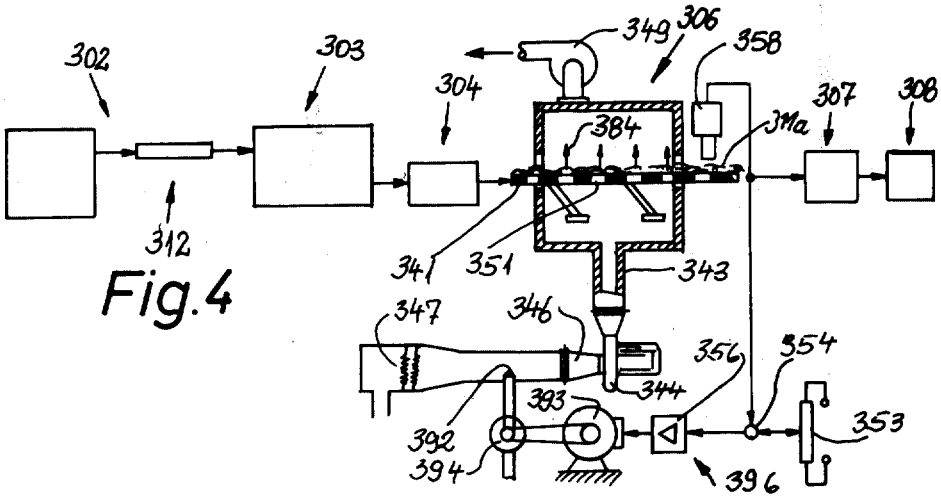
FIG. 4 is a similar view of a fourth apparatus.

All such parts of the conditioning apparatus of FIG. 4 which are clearly analogous to or identical with the corresponding parts of the apparatus of FIG. 1 are denoted by similar reference characters plus 300. The main difference between these apparatus is that the apparatus FIG. 4 comprises a control circuit 396 which can change the rate of delivery of a pump 394 serving to supply water to an atomizing nozzle 392 in the suction pipe 346 for the blower 344 at the inlet of the supply pipe 343 for heated air. The nozzle 392 is disposed downstream of the electric heater 347 and the pump 394 is a conventional variable-delivery pump which is driven by an infinitely variable-speed d-c motor 393. The speed of this motor is changed by signals from a junction 354 which is connected with the motor 393 by an amplifier 356. The junction 354 receives signals from the potentiometer 353 and from the monitoring device 358. When the temperature of tobacco particles leaving the heating unit 306 is excessive, the speed of the motor 393 is increased so that the nozzle 392 discharges a larger quantity of atomized water into the stream of hot air flowing toward the intake of the blower 344. Inversely, the rate of admission of water into the suction pipe 346 is reduced when the measured temperature of tobacco particles is less than that selected by the setting of potentiometer 353.

It will be seen that the apparatus of FIGS. 2, 3 and 4 differ from the apparatus of FIG. 1 in that, whereas the apparatus of FIG. 1 changes the temperature of heating fluid when the measured temperature of tobacco particles deviates from a desired temperature, the apparatus of FIG. 2 changes the rate of tobacco seed into the heating unit 106, the apparatus of FIG. 3 changes the length of intervals of dwell of tobacco particles in the heating unit 206, and the apparatus of FIG. 4 changes the temperature and moisture content of heating fluid whenever the measured temperature deviates from the desired or preselected temperature.

Figure 5:
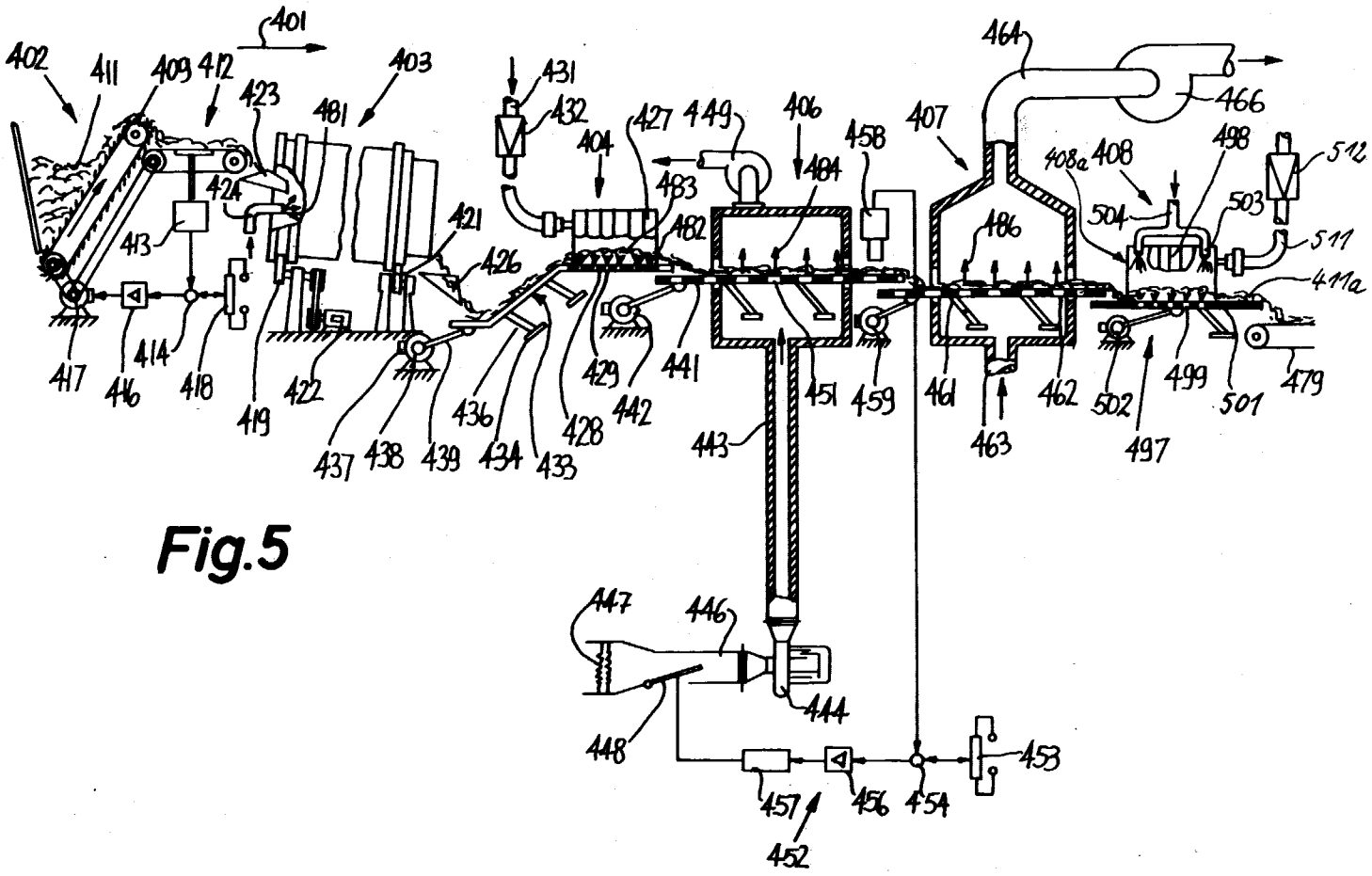
FIG. 5 is a diagrammatic partly elevational and partly longitudinal vertical sectional view of a fifth conditioning apparatus which is largely identical with the apparatus of FIG. 1 but employs a different heating unit.

Referring to FIG. 5, there is shown a fifth apparatus which constitutes a modification of the apparatus of FIG. 1. All such parts of the apparatus of FIG. 5 which are identical with or clearly analogous to the corresponding parts of the apparatus of FIG. 1 are denoted by similar reference characters plus 400.

The moisturizing unit 8 of FIG. 1 is replaced by a modified moisturizing unit 408 whose construction is similar to that of the preconditioning unit 4 or 404. The chamber or housing 408*a* of the unit 408 forms part of a vibratory conveyor 497 which is maintained in motion by an electric motor 502. The wall of the housing 408*a* is formed by a coiled steam pipe 498 and the housing 408*a* has a bottom wall 501 formed with orifices 499 for the discharge of currents of steam which is supplied by a pipe 511 containing a regulating valve 512. If desired, the housing 408*a* can be attached to and vibrated by the conveyor 461, i.e., by the motor 459.

The means for admitting moisture into the housing 408*a* comprises a supply pipe 504 having one or more nozzles 503 which spray atomized liquid (e.g., water) onto the tobacco stream 411*a* in the housing 408*a*. The rate at which the pipe 504 supplies water to the nozzles 503 may be constant or it may be regulated in the same way as described in connection with FIG. 1, i.e., by a control circuit which includes a moisture detector (73 in FIG. 1) located immediately downstream of the housing 408*a*. The nozzles 503 spray atomized liquid from above whereby the particles of liquid impinge upon and raise the moisture content of tobacco particles which are agitated by and ride on a cushion of steam issuing from the orifices 499.

It is clear that the temperature monitoring device 458 of FIG. 5 need not form part of the control circuit 452, i.e., this monitoring device can transmit signals to a control circuit of the type described in connection with FIGS. 2, 3 or 4.

An important advantage of the improved method and apparatus is that the treatment in the preconditioning unit (with accurately controlled quantities of steam and with simultaneous accurately controlled agitation of tobacco particles) insures that the steam condenses on the particles of tobacco which in turn results in opening of the pores and deep penetration of moisture and casing into the fibrous structure of tobacco. Moreover, the feature that the steam condenses during transport of tobacco particles through the preconditioning unit is desirable on the additional ground that the speed of steam decreases automatically with minimal escape (or without any escape) of surplus steam from the housing of the preconditioning unit. Such slowing-down of steam can be achieved without resorting to divergent side walls or other complex bulky and expensive auxiliary equipment which is used in certain presently known conditioning apparatus, for example, to insure a deceleration of heating, cooling and/or moistening agents.

Another advantage of the improved method and apparatus is that the aforedescribed conditioning insures a highly satisfactory treatment of practically all types of tobacco, including Burley, i.e., also such types which must be contacted with and must retain relatively large quantities of casing and/or which must be heated to an elevated temperature in order to insure complete or nearly complete expulsion of nitrogen. It has been found that such tobacco types can be heated to a high temperature within a very short interval of time to effect the expulsion of a high percentage of moisture and to thus insure roasting of casing and the attendant change in taste but without any danger of undesirable discoloration and/or burning or charring of tobacco particles. Moreover, the expulsion of nitrogen can be completed within a very short interval of time without any or with negligible incrustation of the outermost layers of tobacco particles.

The provision of means for directly monitoring the temperature of tobacco particles, preferably immediately downstream of the heating unit, is desirable and advantageous because such monitoring close to the locus of heating allows for practically instantaneous corrective measures if the monitored temperature deviates from that temperature which is best suited for optimum roasting of casing which has penetrated into the fibrous structure of tobacco. As described in connection with FIGS. 1–4, the corrective measures may involve changing the temperature of a hot gaseous medium, changing the temperature and moisture content of the heating medium, changing the length of intervals of contact of tobacco particles with the heating medium, or changing the quantity of tobacco which is being fed to the heating unit. It has been found that the taste of tobacco particles can be determined with a high degree of reproducibility if the temperature of tobacco particles leaving the heating unit matches the preselected optimum temperature or deviates from such optimum temperature only negligibly and always for a very short interval of time, i.e., for as long as is necessary to carry out the necessary corrective measure or measures.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

1. In a method of conditioning tobacco, the steps of transporting a continuous stream of tobacco particles along a predetermined path, including vibrating the particles of the stream; continuously conveying across a predetermined portion of said path a plurality of ascending currents of steam; and maintaining said currents at a pressure at which the currents together form a cushion supporting the particles of tobacco during transport along said portion of said path and at which at least the major portion of steam entering said portion of said path condenses on and is entrained by tobacco particles beyond said portion of said path.

2. In a method as defined in claim 1, the additional steps of maintaining the particles of tobacco upstream of said portion of said path at a relatively low first temperature and of conveying said currents at a second temperature which is sufficiently higher than said first temperature to insure that, owing to said pressure and the difference between said first and second temperatures, at least a substantial portion of steam undergoes condensation and the condensed steam deposits on the particles of tobacco.

3. In a method as defined in claim 2, the additional steps of heating the particles of tobacco in a second portion of said path, cooling the thus heated particles in a third portion of said path, and increasing the moisture content of thus cooled particles in a fourth portion of said path.

4. In a method as defined in claim 3, wherein said heating, cooling and moisture content increasing steps include contacting the particles of tobacco with streamlets of a fluid medium.

5. In a method as defined in claim 4, wherein at least one of said media is steam.

6. In a method as defined in claim 3, the additional steps of measuring the temperature of tobacco particles between said second and third portions of said path, comparing the measured temperature with a predetermined value, and changing at least one factor which influences the temperature of tobacco particles in said second portion of said path when the measured temperature deviates from said predetermined value.

7. In a method as defined in claim 6, wherein said measuring step comprises directly monitoring the temperature of tobacco particles immediately downstream of said second portion of said path.

8. In a method as defined in claim 6, wherein said heating step comprises contacting tobacco particles with a hot gaseous fluid and said changing step comprises changing the temperature of said gaseous fluid.

9. In a method as defined in claim 6, wherein said changing step comprises varying the rate at which the particles of tobacco are transported along said second portion of said path.

10. In a method as defined in claim 6, wherein said changing step comprises varying the speed of transport of tobacco particles along said second portion of said path.

11. In a method as defined in claim 6, wherein said heating step comprises contacting the particles of tobacco with a hot gaseous fluid and said changing step comprises varying the moisture content of said gaseous fluid.

12. In a method as defined in claim 3, wherein said moisture content increasing step comprises simultaneously contacting the particles of tobacco with steam and an atomized liquid.

13. In a method as defined in claim 12, wherein the steam is conveyed across said fourth portion of said path in the form of ascending currents together forming a second cushion for the particles moving along said fourth portion of said path and said atomized liquid is water which is sprinkled onto the particles on said second cushion.

14. In a method as defined in claim 1, the additional steps of contacting successive increments of the stream with an atomized liquid in a second portion of said path located upstream of said predetermined portion whereby such liquid penetrates into the fibrous structure of tobacco particles as a result of subsequent contact between liquid-carrying particles and steam in said predetermined portion of said path owing to the opening of pores of tobacco particles by steam, and heating the particles to an elevated temperature in a third portion of said path downstream of said predetermined portion.

15. In a method as defined in claim 14, wherein said atomized liquid is casing.

16. In an apparatus for conditioning tobacco, a combination comprising elongated vibratory conveyor means defining an elongated path and having a portion provided with a plurality of orifices in said conveyor means; means for supplying into said conveyor means a continuous stream of tobacco particles whereby said conveyor means transports the particles along said path and above said orifices; means for supplying to said orifices steam which issues from said orifices in the form of ascending currents; and means for regulating the pressure of steam in said steam supplying means so that said currents form a cushion which supports the particles of tobacco during transport by said portion of said conveyor means and that at least the major portion of steam issuing from said orifices condenses on and is entrained by tobacco particles beyond said portion of said conveyor means.

17. A combination as defined in claim 16, wherein said portion of said conveyor means constitutes an open-ended housing having a bottom wall and said orifices are provided in said bottom wall.

18. A combination as defined in claim 17, further comprising means for heating the particles of said stream downstream of said portion of said conveyor means, means for cooling the thus heated particles downstream of said heating means, and means for increasing the moisture content of cooled particles.

19. A combination as defined in claim 17, wherein said housing includes at least one length of pipe which surrounds the corresponding portion of said path and said steam supplying means feeds steam into said pipe so that the thus heated pipe prevents condensation of steam thereon.

20. A combination as defined in claim 19, wherein said pipe comprises a plurality of immediately adjacent coils.

21. A combination as defined in claim 17, further comprising means for heating the particles of said stream downstream of said portion of said conveyor means, means for cooling the thus heated particles, means for measuring the temperature of tobacco particles between said heating and cooling means, means for comparing the measured temperature with a predetermined value, and means for changing at least one factor which influences the temperature of tobacco particles in said heating means when the measured temperature deviates from a predetermined value.

22. A combination as defined in claim 21, wherein said measuring means comprises a device for directly monitoring the temperature of tobacco particles immediately downstream of said heating means.

23. A combination as defined in claim 21, wherein said heating means comprises a chamber surrounding a second portion of said conveyor means and means for conveying ascending streamlets of hot air across said second portion of said conveyor means so that said streamlets exchange heat with tobacco particles while the particles are agitated and transported by said conveyor means, said changing means including a device for varying the temperature of hot air.

24. A combination as defined in claim 21, wherein said stream supplying means comprises an adjustable tobacco feeding device and said changing means includes a control system for adjusting the speed of said feeding device to thus change the rate of tobacco transport along said path.

25. A combination as defined in claim 21, wherein said changing means comprises a control system for changing the frequency of vibrations of said conveyor means and for thus changing the length of intervals of contact between tobacco particles and a heating fluid.

26. A combination as defined in claim 21, wherein said heating means comprises a device for conveying across the tobacco stream a plurality of streamlets of hot air whereby the streamlets exchange heat with tobacco particles and said changing means comprises a device for changing the moisture content of said streamlets.

27. A combination as defined in claim 16, further comprising means for heating the particles of said stream downstream of said portion of said conveyor means, means for cooling the thus heated particles and means for increasing the moisture content of cooled particles, said moisture content increasing means comprising a housing surrounding the corresponding portion of said path and having a bottom wall provided with a plurality of upwardly opening second orifices, means for supplying to said second orifices steam at a pressure at which the currents of steam issuing from said second orifices form a second cushion supporting the particles of tobacco in said housing, and means for contacting the particles on said second cushion with an atomized liquid.

28. A combination as defined in claim 27, wherein said housing comprises at least one steam pipe and said last mentioned steam supplying means feeds steam to said pipe, said means for contacting the particles of tobacco with atomized liquid comprising at least one nozzle disposed in said housing and arranged to spray atomized liquid downwardly onto the particles of tobacco on said second cushion.

29. A combination as defined in claim 16, wherein said stream supplying means comprises a preconditioning unit located upstream of said portion of said conveyor means and including means for contacting successive increments of the tobacco stream with an atomized liquid, such as casing.

* * * * *